US006913084B2

(12) United States Patent
Boyd

(10) Patent No.: US 6,913,084 B2
(45) Date of Patent: Jul. 5, 2005

(54) METHOD AND APPARATUS FOR CONTROLLING WELL PRESSURE WHILE UNDERGOING SUBSEA WIRELINE OPERATIONS

(76) Inventor: Anthony R. Boyd, 2204 Turnberry Dr., Loreauville, LA (US) 70552

( * ) Notice: Subject to any disclaimer, the term of this patent is extended or adjusted under 35 U.S.C. 154(b) by 123 days.

(21) Appl. No.: 10/368,130

(22) Filed: Feb. 18, 2003

(65) Prior Publication Data

US 2003/0121666 A1 Jul. 3, 2003

Related U.S. Application Data

(63) Continuation-in-part of application No. 10/119,172, filed on Apr. 9, 2002, now abandoned, which is a continuation of application No. 09/571,787, filed on May 16, 2000, now Pat. No. 6,367,553.

(51) Int. Cl.[7] ..... E21B 33/076

(52) U.S. Cl. ..... 166/385; 166/241.5; 166/360; 166/368; 175/5

(58) Field of Search ..... 166/241.5, 359, 166/360, 367, 368, 385; 175/5

(56) References Cited

U.S. PATENT DOCUMENTS 3,656,549 A 4/1972 Holbert, Jr. et al.
4,307,783 A * 12/1981 Lanmon, II ..... 166/379
4,313,694 A 2/1982 Cox
4,673,041 A * 6/1987 Turner et al. ..... 166/340
4,836,289 A * 6/1989 Young ..... 166/379
6,263,982 B1 7/2001 Hannegan et al.

* cited by examiner

*Primary Examiner*—Zakiya Walker
(74) *Attorney, Agent, or Firm*—Domingue & Waddell, PLC

(57) ABSTRACT

Method and assembly for conducting wireline operations in a deep, subsea location. The method includes providing a rig on the surface of a body of water, having a riser extending from the rig floor to the sea floor; an annular preventer positioned on the end of the riser on the sea floor; a plurality of blowout presenters positioned below the riser to prevent a blowout into the riser; and, a wireline subsea blowout preventer control head. A lubricator is lowered into the riser, with the control head attached thereto, and wherein the wireline tool is disposed within the control head. The lubricator is position within the annular preventer. Wireline operations may then be conducted. If a blowout occurs during wireline operations, any pressure would be prevented from entering the riser, and would be contained by the control head.

35 Claims, 12 Drawing Sheets

METHOD AND APPARATUS FOR CONTROLLING WELL PRESSURE WHILE UNDERGOING SUBSEA WIRELINE OPERATIONS

CROSS-REFERENCE TO RELATED APPLICATIONS

This is a continuation in part application of Ser. No. 10/119,172 filed on 9 Apr. 2002 now abandoned which is a continuation application of Ser. No. 09/571,787 filed 16 May 2000, now U.S. Pat. No. 6,367,553.

BACKGROUND OF THE INVENTION

1. Field of the Invention

The apparatus and method of the present invention relates to wireline operations in the recovery of oil and gas. More particularly, the present invention relates to a method and apparatus for controlling well pressure while undergoing wireline operations on subsea blowout preventers on the subsea floor.

2. General Background of the Invention

In conducting wireline operations, many types of tools are positioned on the lower end of a wireline, which is a steel cable or the like, lowered into the well bore in order to undertake certain tests downhole. Because in the past there have been difficulties in undertaking wireline work with the potential hazard of blowouts in the well, there has been developed and patented by Harper Boyd, a side entry sub assembly which is patented under U.S. Pat. No. 4,681,162 and reissued under U.S. RE 33,150. This patented device, which is placed below the top drive on the rig floor, includes a side entry portion which enables the wireline to extend through the side entry passage and into the main passage and downward into the drill string. Although the use of the side entry sub is common for drilling, the system has never been applied safely on subsea blowout preventers which are located in deep water, since controlling the well pressure at deep depths is very difficult. In deep waters of the Gulf of Mexico, there would be provided a floating subsea riser which would extend from the rig floor, on the Gulf surface, to the blowout preventers on the floor of the Gulf, sometimes some 4,000 to 10,000 feet in distance. It would be quite impractical to run a high-pressure line from the rig floor to the BOP stack on the Gulf floor to tie into the annular preventer so that one could pressure test the wireline. The BOP's need to be pressure tested, but the riser cannot take high pressure tests above the blowout presenters, or it would rupture and expel hydrocarbons into the Gulf waters. So, there is a need to be able to conduct subsea wireline operations in deep waters under pressure so that in the event a well would "come in" during the operations, the blowout would not reach the riser to the rig floor to avoid rupture of the floating subsea riser and a major catastrophe.

BRIEF SUMMARY OF THE INVENTION

The apparatus and method of the present invention solves the problems in a simple and straightforward manner. What is provided is a method for conducting wireline operations in a deep, subsea location, which includes providing a rig on the surface of a body of water, having a riser extending from the rig floor to the floor of the deep body of water; an annular preventer positioned on the end of the riser on the sea floor; a plurality of rams, including blind and pipe rams positioned below the riser to prevent a blowout into the riser (the annular preventer and rams may be referred to as the blowout preventers or BOPs or BOP stack); a wireline subsea blowout preventer control head assembly (the assembly) lowered into the riser on a lubricator to the level into the annular preventer; placing the lubricator within the blowout preventers; lowering a wireline disposed through the assembly so that the tool within the assembly may be lowered beyond the blowout preventers to conduct wireline operations; providing a means to pressure off the lubricator so that should a blowout occur during wireline operations, any pressure would be prevented from entering the riser, but would be contained by the lubricator.

In a second preferred embodiment, a method of conducting wireline operations with a wireline tool on a wireline into a subsea well is also disclosed. The method includes providing a rig having a riser extending from a rig floor, with the riser extending to a BOP stack on the sea floor. A casing lubricator is concentrically lowered into the riser and then the wireline tool is concentrically lowered through the casing lubricator and into the riser.

The method includes suspending the wireline at the top of the casing lubricator and placing within an internal portion of a first drill pipe a stripping cable. The stripping cable is connected to the wireline suspended at the top of the casing lubricator. The method further comprises connecting the first drill pipe to the casing lubricator, and thereafter lowering the casing lubricator.

Next, the wireline is suspended at the top of the first drill pipe, and the wireline is disconnected from the stripping cable. The method further comprises placing within an internal portion of a second drill pipe the stripping cable, and connecting the stripping cable to the wireline suspended at the top of the first drill pipe. Next, the second drill pipe can be connected to the first drill pipe, and then, the second drill pipe is lowered. The steps of suspending the wireline at the top of the first drill pipe through lowering the drill pipe is known as stripping into the well, and the lowering of the drill string lubricator into the riser by stripping the stripping cable is performed until the casing lubricator is at an annular preventer located in the BOP stack, with the drill string lubricator extending up to the rotary table on the drill floor.

The method further includes closing the annular preventer about the casing lubricator. The operator can then rig up a control head assembly at the top of the drill string. In one embodiment, when the annular preventer is closed about the casing lubricator, a seal is formed about the casing lubricator and the method further comprising testing the seal about the casing lubricator.

In another embodiment, the step of lowering the wireline tool further includes closing a blind ram within the BOP stack, and then, lowering the wireline tool to above the closed blind ram. The method further comprises opening the blind ram and lowering the wireline tool into the well.

In one embodiment, the step of suspending the wireline is accomplished by placing a cable t-clamp about the wireline and installing a rope socket. Additionally, the steps of suspending the wireline at the top of the drill string lubricator includes providing a c-plate means and engaging the c-plate means with a rope socket that is attached to the wireline.

In one of the preferred embodiments, the control head assembly may be a side entry device. The control head assembly may have a first passage for the wireline and a second fluid passage. The fluid passage may be used for pumping the fluid through the second passage into the lubricator. In one of the preferred embodiments, the wireline is an electric wireline and the method further comprising performing logging operations with the wireline tool.

An advantage of the present invention includes increased safety since the work string is concentrically located within the riser and sealed within the annular preventer. Another advantage is that the operator can pump a kill fluid through the control head or side entry device if an unexpected pressure develops within the inner portion of the lubricator.

Yet another advantage is the method disclosed herein requires a minimum amount of casing to be run while the remainder of the work sting is drill pipe. This results in a savings on the cost of the rental of casing. Casing is larger and bulker than drill pipe, and therefore, takes up more room on these exotic locations. Thus, another advantage is the method employed uses less casing and therefore, takes up less space and requires less support such as vessels to transport and stage the process.

Therefore, it is an object of the present invention to provide a system for conducting wireline operations in subsea conditions at the floor of the seabed, so as to prevent any undue pressure from rupturing the riser between the rig floor and the subsea floor.

It is a further object of the present invention to provide a method of conducting wireline operations deep within subsea conditions, without subjecting the riser between the rig floor and the seabed to blowout pressures.

It is a further object of the present invention to provide a wireline subsea blowout preventer control head assembly system used in subsea conditions for allowing wireline work to be conducted at the sea floor, under pressure, so as to allow pressure testing of components of the system without fear of compromising the integrity of the riser which may cause a catastrophic oil or gas spill into the body of water. These, as well as many other objects, will be apparent from a reading of the following description.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
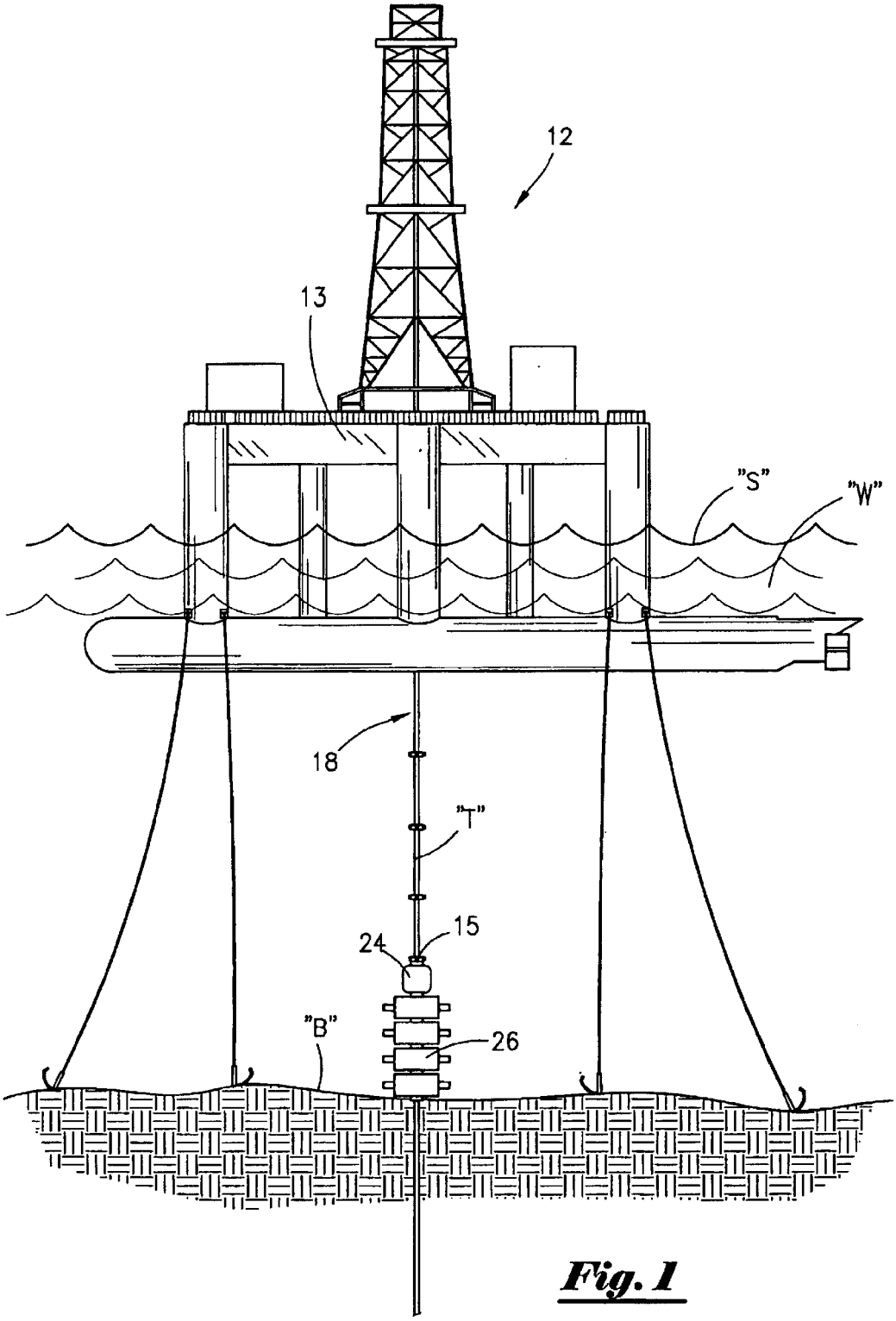
FIG. 1 illustrates an overall view of a typical rig and subsea assemblies positioned within a deep water setting during drilling offshore.

FIGS. 1–7 illustrate a first embodiment of the system of the wireline subsea blowout preventer control head assembly (assembly) of the present invention. The assembly is illustrated by the numeral 10, as seen in FIGS. 2, 3 and 4A–4C. Prior to discussing assembly 10 in detail, reference is made to FIG. 1, where there is illustrated in cross section a typical rig 12 positioned on the surface S of a body of water W, such as the Gulf of Mexico. The rig would include an extended riser 18, comprising a plurality of tubular elements T, stacked and flanged with bolts to define the entire riser 18 extending from the rig floor 13, to the seabed B. For purposes of this discussion the rig 12 may be in water as deep as 10,000 feet, or even deeper, and the riser 18 would therefore be 10,000 feet in overall length. Such a riser is normally some 20 inches in diameter, but can only withstand internal pressures of around 2000 lbs. before the riser would rupture. This, of course, must be avoided since such a rupture may allow fluid hydrocarbons to spill out into the body of water, a catastrophic event.

As part of the overall assembly, the lower end 15 of the riser 18 would terminate and attach to an annular preventer 24, known in the art, and commercially available from Hydril Inc., and would not have to be discussed in detail. The annular preventer 24 is positioned above a series of blowout preventers 26 (BOP's 26), which together would prevent any blowout or excess pressure from downhole to be prevented by closing off the passage of the fluids up the riser 18. The BOP's 26 may be a series of blind and pipe rams very well known in the art.

Figure 2:
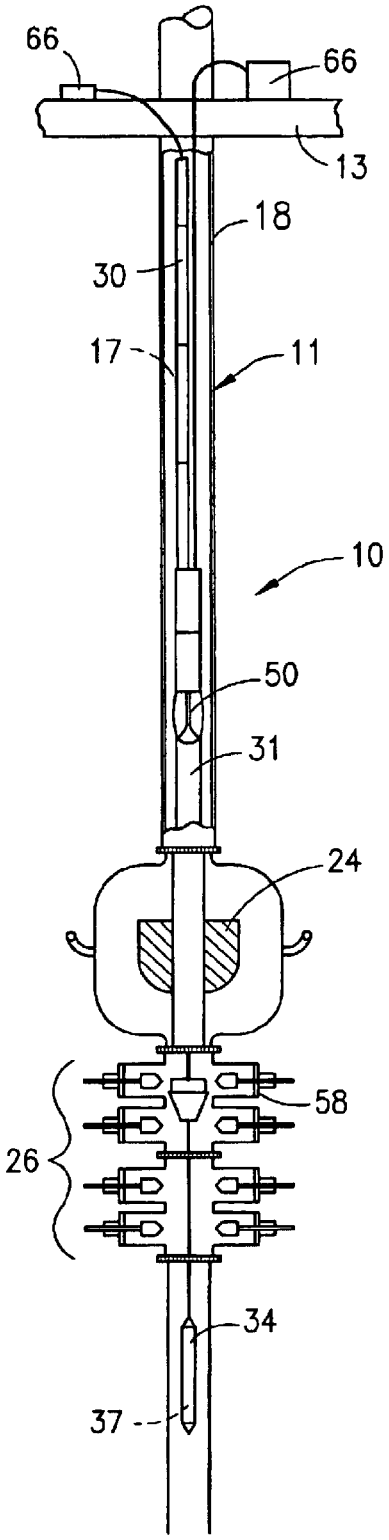
FIG.2 illustrates an overall view of a typical rig and subsea assemblies positioned within a deep water setting during drilling offshore utilizing one of the systems of the present invention.
Figure 3:
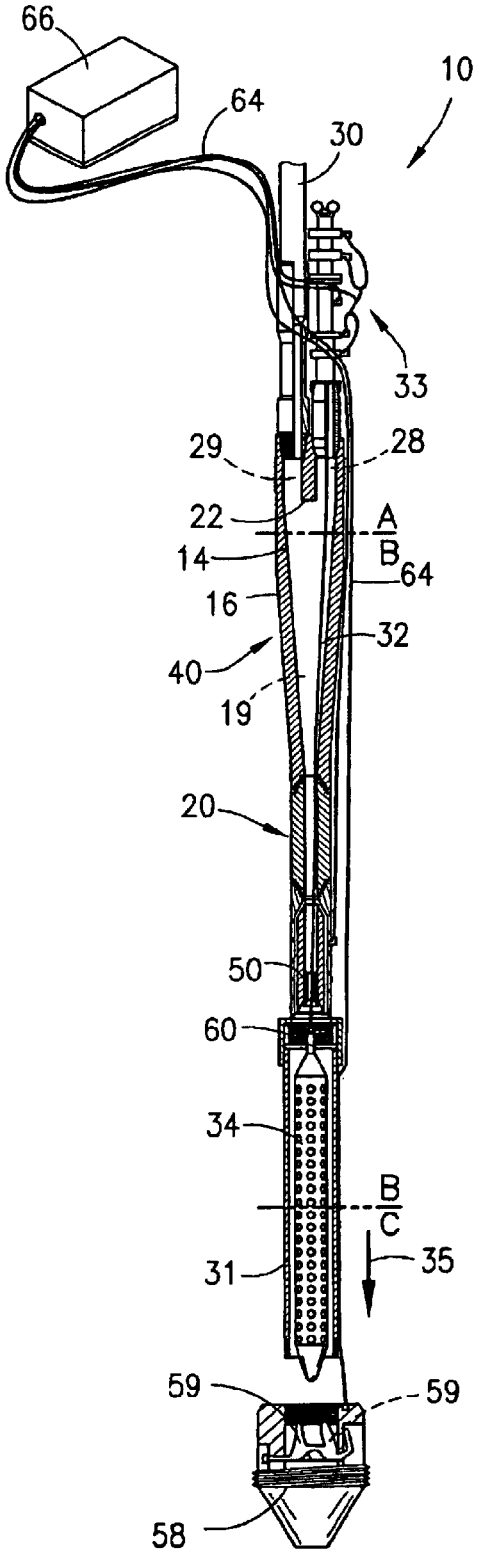
FIG. 3 illustrates a detailed view of one of the wireline subsea blowout preventer control head assemblies used in the present invention for conducting subsea wireline work under pressure.
Figures 4A, 6:
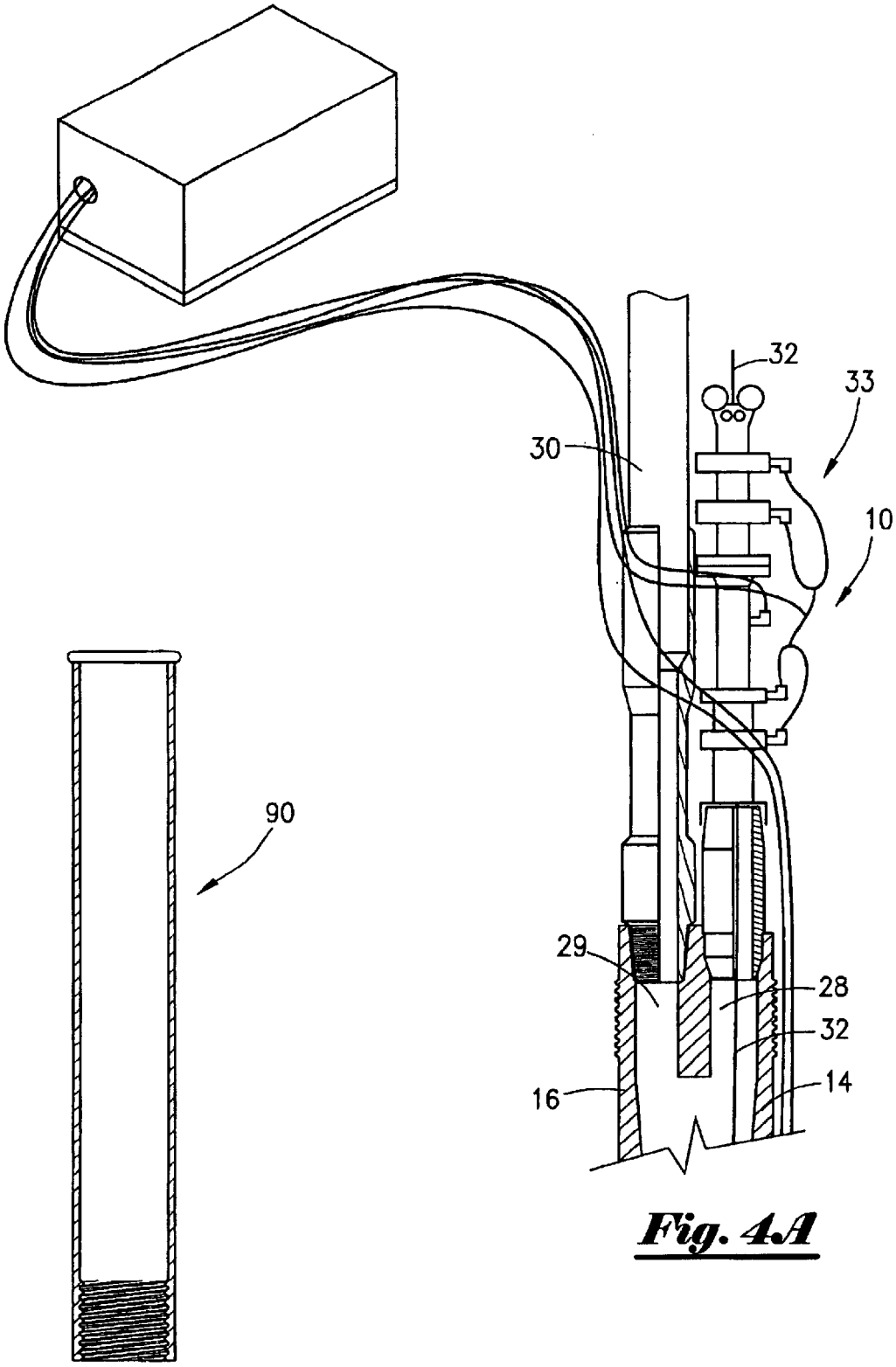
FIGS. 4A through 4C illustrate isolated detailed views of one of the wireline blowout preventer control head assembly embodiments used in the present invention for conducting subsea wireline work under pressure.
FIG. 6 illustrates a view of a protective sleeve used in the present invention.
Figure 4B:
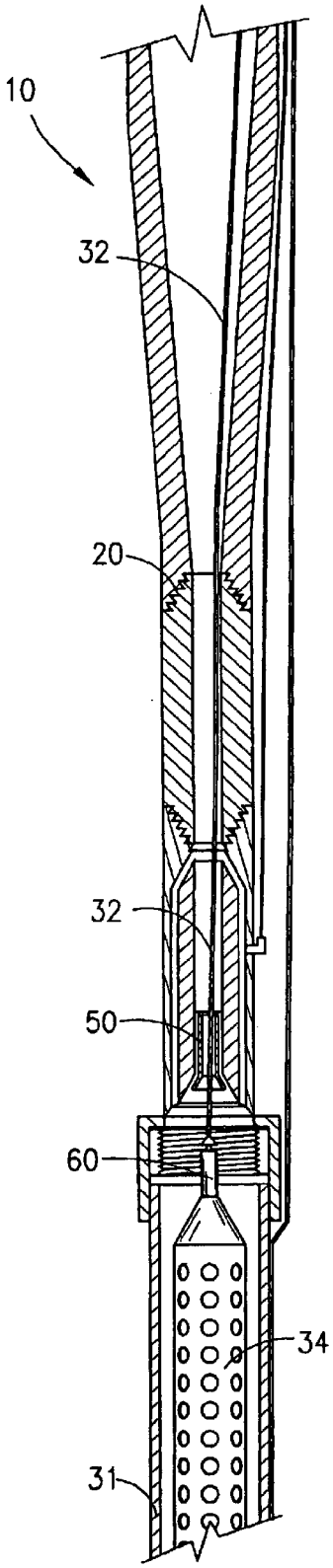
Figure 4C:
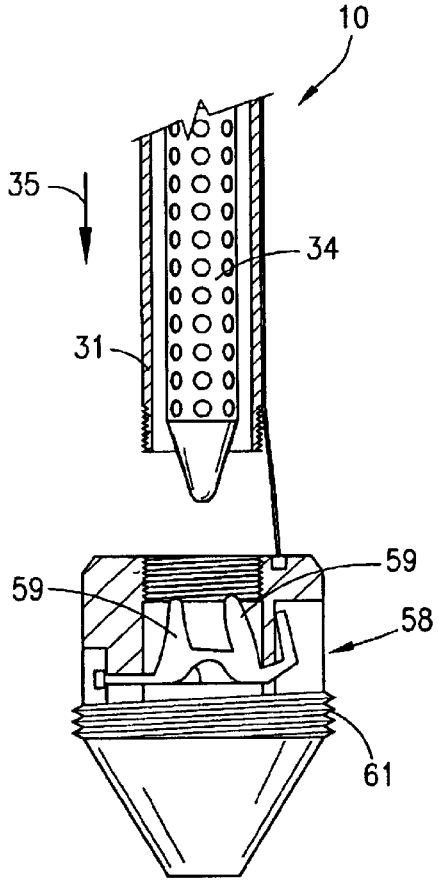

Reference is now made to FIG. 2 which illustrates the assembly 10, together with the components to provide the overall assembly of the present invention. As seen in FIG. 2, the riser 18 has contained therein a length of drill pipe 30 which has been lowered down the bore 17 of the riser 18. The drill string 30 would include the assembly 10 at its lower end. Extending below the assembly 10 is the casing 31, which is referred to as the pipe 31. The assembly 10, which is sometimes referred to as the wireline entry assembly 10, would be seen in more detail in FIGS. 3 and 4A–4C, and in general, would include a principal tool body 14 with a circular outer wall 16, the tool body 14 having a principal passage portion 19 extending from the lower end 20 of the tool body to an upper point 22 of the tool body as illustrated in FIG. 3. There is further illustrated the passage 29 extending into a first principal passage 19 which would be threaded onto the drill string 30, as seen in the FIG. 3. There is formed a second passage 28 which has a packoff assembly portion 33 secured therethrough wherein a wireline (line 32) extends therethrough downward into the principal passage 19 of the tool and down into the annulus of the lower pipe 31. As seen in FIG. 3, wireline 32 has a tool 34 at its end moving in the direction of arrow 35 down the borehole 37.

It is important to note with the use of the assembly 10 as seen in FIGS. 3 and 4A–4C, there is provided a head catcher 50 secured to the lower end 20 of the assembly 10, the head catcher of the type commonly used in grease work on a rig, but not heretofore used in connection with high pressure wireline operations conducted at subsea depths. The tool head catcher 50 secured to the lower end of the assembly 10 is connected at its lower end to the length of assembly 10, with the lower end of the pipe 31 connected to a tool trap 58, again known in the art in oilrig grease work, but not with subsea high pressure wireline operations.

As seen further in FIG. 2, the wireline tool 34 is extending through the opening in the tool trap 58, and is being moved downhole. The tool 34 had been disposed within the assembly 10 before the assembly 10 was lowered into the riser 18. The tool 34 is lowered through the open BOP's below the tool trap 58 for moving downhole to conduct wireline operations. With the pipe 31 secured within annular preventer 24, there is no possibility of the assembly 10 rotating or wrapping the stainless steel or hydraulic lines 64 that extend down the drill string 30 from the source 66, as seen in FIGS. 2 and 3.

For clarification, the tool trap 58 is well known in the art, in that it is a spring-loaded assembly which remains open as long as a wireline tool 34 is extending through it. When the tool 34 moves above the trap 58, a spring-loaded trap door 59 closes to seal off the opening, so that the tool 34 may not inadvertently be dropped below the trap 58. When the tool 34 moves above the trap 58, a spring-loaded trap door 59 closes to seal off the opening, so that the tool 34 may not inadvertently be dropped below the trap 58. If however the tools were pulled up too high and hits the head catcher 50, the head catcher will latch on the rope socket 60, to hold on to the tools if the wireline is pulled out of the rope socket 60. If however the head catcher 50 fails, then the trap door 59 is closed due to it being spring loaded, and therefore, the tools are kept from falling down hole.

Referring again to FIG. 2, during operation, the method would include lowering a drill string 30 with the assembly 10 down the annulus of the riser 18. The assembly 10 would have a head catcher 50 secured to the assembly's lower end, and a section of pipe 31 extending down from the catcher 50. The pipe 31 would have a tool trap 58 secured to its lower end. When the pipe 31 has been lowered into the opening of the annular preventer 24, these are closed around the pipe 31, between the head catcher 50 and the tool trap 58. The BOP's 26 would also be secured around the pipe 31, therefore eliminating any chance of pressure moving up the annulus between the riser 18 and the drill string 30. The wireline tool 34, which had already been placed within the assembly 10, would be lowered through the opening in the tool trap 58 and down the borehole. Wireline work can then safely be done under pressure. Should a blowout occur downhole, the BOP's and annular preventer would prevent high pressure from entering the annulus formed between the riser 18 and drill string 30, and further, the assembly 10 would not allow the pressure to move into the annulus of the riser 18, but would be captured by the packoff assembly portion 33. Thus, it is possible to test the seal within the annular preventer 24 as well as testing the packoff assembly portion 33 thereby testing the inner diameter of the tubular members.

Figure 5:
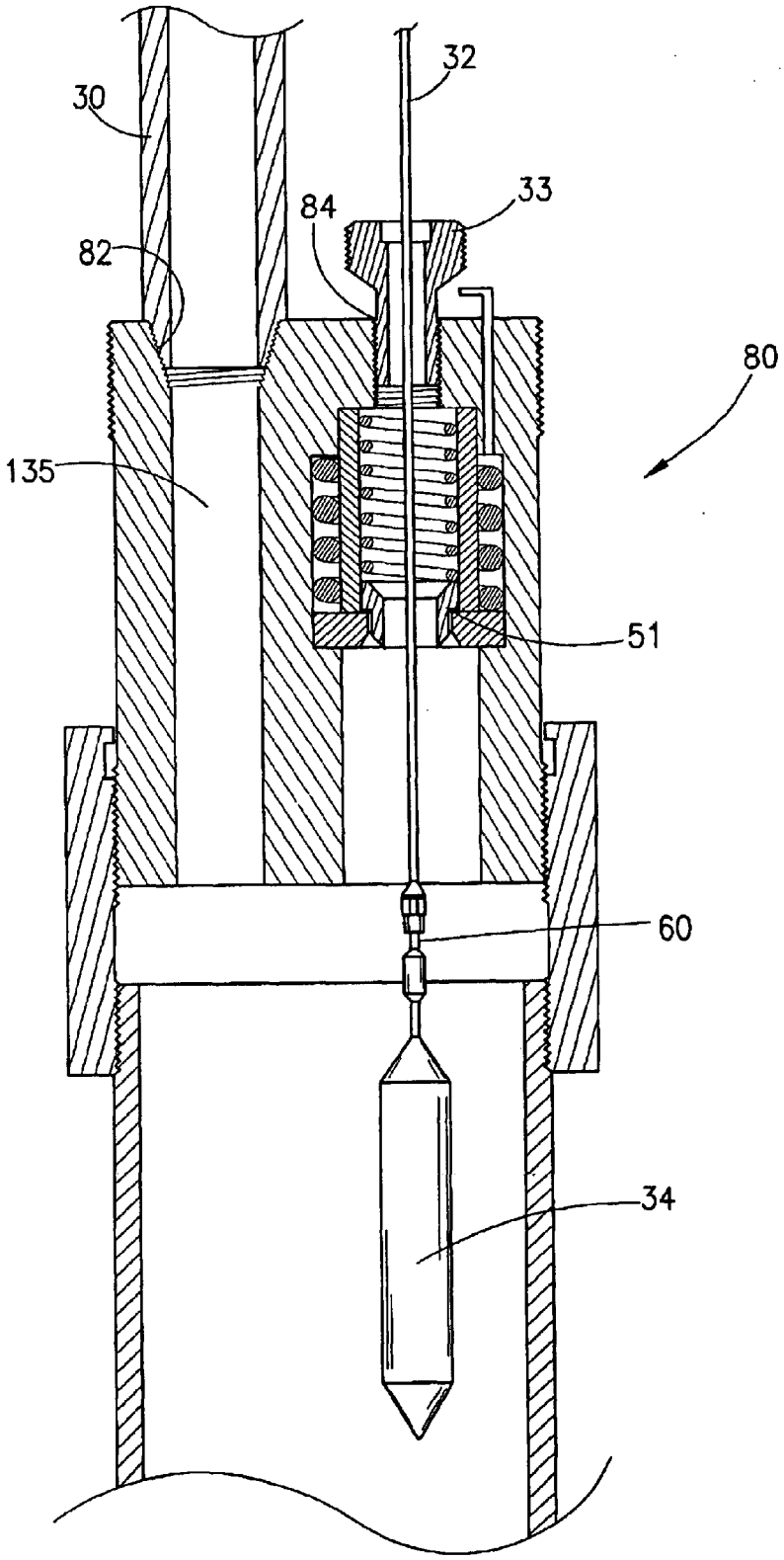
FIG. 5 illustrates a view of a second wireline blowout preventer control head assembly for use in the method of the present invention.

FIG. 5 illustrates a modified control head assembly 80 that includes a tool head catcher 51. As illustrated, there would be a primary threaded connection 82 for connecting onto a section of drill pipe 30. The packoff assembly portion 33 of the control head assembly 80 would connect at point 84, which in effect creates a much shorter control head assembly 80 and head catcher connection so as to allow the use of an external protective sleeve 90 to be slid on top of the assemblies, of the type illustrated in FIG. 6. Therefore, the hydraulic lines 64, seen in FIG. 3, would be within the protective sleeve 90, including other components of the downhole assembly 80 to avoid being exposed to the outside. It should be noted that control head assembly 10 and the modified control head assembly 80 are similar in that they both perform a like function of allowing entry of the wireline into a tubular string with the necessary packoff.

Figure 7:
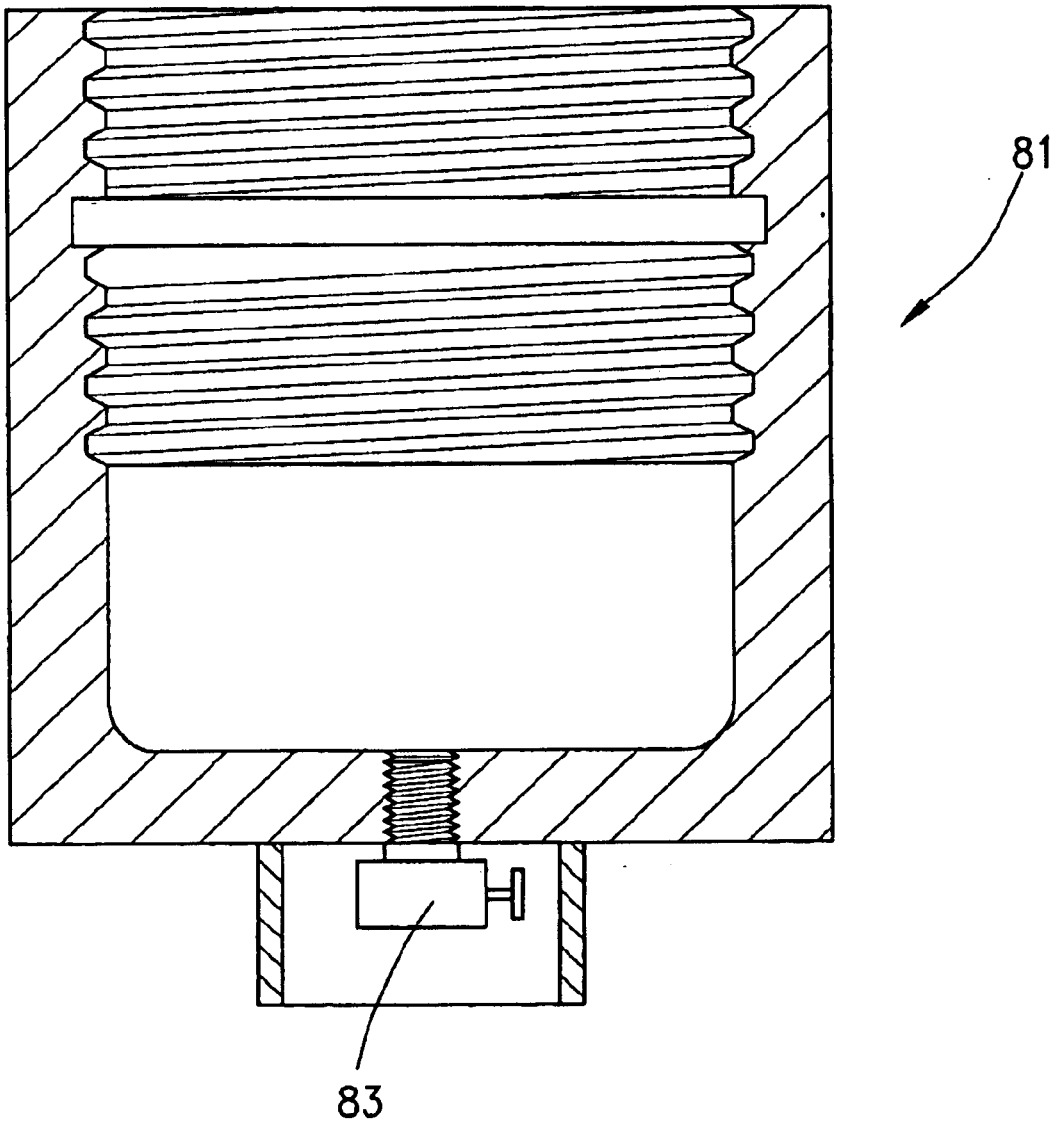
FIG. 7 illustrates a view of a cap member positionable on the end of the tool trap used in the present invention.

FIG. 7 illustrates a cap member 81 which would be threadably engaged on the lower end 61 of tool trap 58 (seen in FIG. 4C) when the integrity of the system would be pressure tested at the surface, with cap 81 including a valving member 83 to release pressure during or after the test.

Referring now to FIGS. 8 through 13, a second embodiment, which is the preferred embodiment of this application, will now be discussed. As set out in FIG. 8, this second preferred embodiment utilizes a typical drilling rig and subsea components positioned within a deep water environment during exploration, drilling and completion operations. It should be noted that like numbers appearing in the various figures refer to like components. Thus, the rig 12 is positioned within a body of water W. The rig 12 has a rig floor 13 where a rotary table 102 is operatively contained thereon as is well understood by those of ordinary skill in the art. The rig 12 may be a drill ship or a semi-submersible rig, even though the invention herein disclosed is applicable to all types of rigs.

Figure 8:
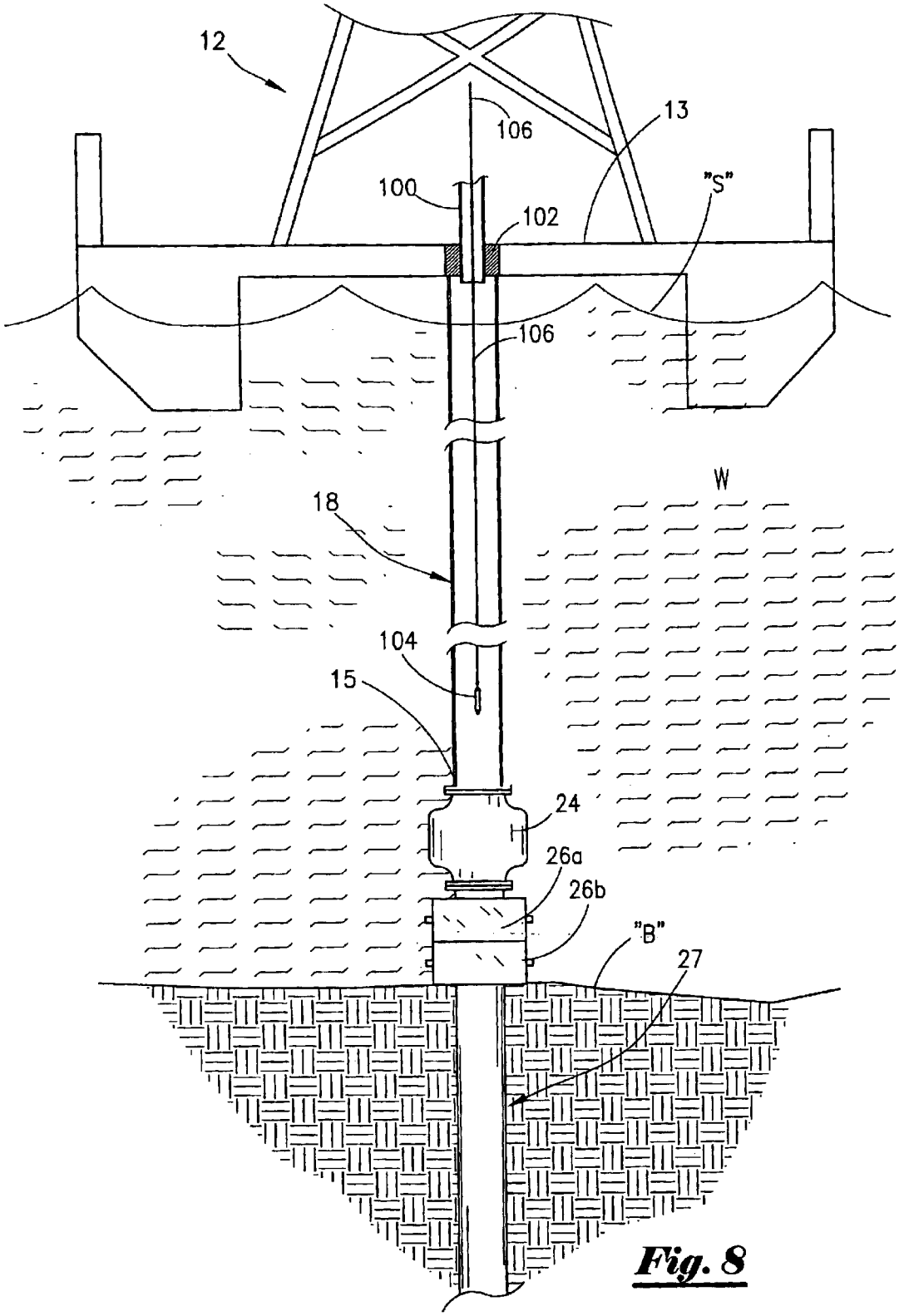
FIG. 8 illustrates a typical rig and subsea components positioned within a deep water setting during drilling offshore in a second preferred embodiment.

As seen in FIG. 8, a riser 18 extends from the rig floor 13 to the sea bed B. More particularly, the lower end 15 of the riser 18 is attached to the annular preventer 24, and extending from the annular preventer 24 is the blind rams **26*a* and pipe rams 26*b*. The annular preventer 24 is commercially available from Hydril Corp. and the blind rams 26*a* and the pipe rams 26*b* are commercially available. A well 27** extends into the subterranean area beneath the ocean wherein the well will penetrate hydrocarbon reservoirs as is well understood by those of ordinary skill in the art.

FIG. 8 depicts a joint of casing 100 that is contained within the rotary table 102 of the rig 12. The joint of casing 100 is a tubular member that is very well known in the industry. As noted earlier, a method of performing wireline operations with a wireline tool 104 in this subsea environment is disclosed. The method includes determining the size of the casing which consists of calculating the outer diameter size of the casing required and the length of the casing required. For instance, if the wireline tools to be run have an outer diameter of 7" and the length of the wireline tools is 40', then the casing would need to be a 8.5" inner diameter and the length of the casing would need to be about 100'. Generally, casing has a larger inner diameter than standard drill pipe. Thus, the outer diameter size of the wireline tools prevents the use of standard drill pipe and necessitates the use of casing.

The joint of casing 100 is placed within the rotary table 102 on the rig 12 as seen in FIG. 8. As those of ordinary skill will appreciate, drill collar slips can be used to lock the joint of casing 100 in the rotary table 102.

Then, the operator can run into the riser 18 with the wireline 106. The wireline can be a slick line, braided line, electric line or other cable. Before running into the well, the wireline tool 104 can be checked out at the surface in order to ensure that the tool 104 is correctly assembled. In the case where the tools are electronic, the tools are tested for competency and that they form part of a complete circuit. The wireline tool 104 can be lowered via conventional means such as a wireline unit on wireline 106 into the riser 18. In one of the preferred embodiments, the operator will lower the wireline tool 104 to the ocean floor, and more specifically, will lower to just above the blind rams 26*a*. The blind rams 26*a* may be closed so that the possibility of tool 104 detaching and falling downhole is obviated.

It should be noted that in this application, a single joint of casing is referred to as a joint of casing 100 (FIG. 8). The collective joints of casing lowered into the riser is referred to as the casing lubricator 105 (see FIG. 11). A single drill pipe is referred to as a drill pipe joint 117 (see FIG. 9). The collective drill pipe joints lowered into the riser is referred to as the drill string lubricator 118 (see FIG. 11). And, the collective drill string lubricator 118 together with the casing lubricator 105 is referred to as the lubricator 120 (see FIG. 11).

Figure 13:
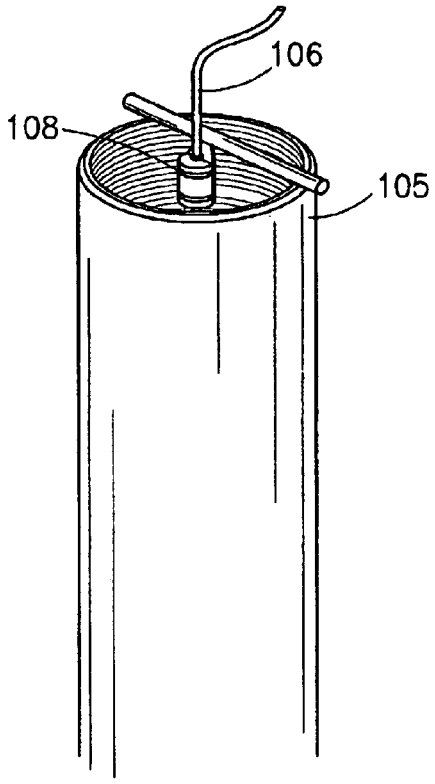
FIG. 13 illustrates a typical cable clamp employed with the invention herein described.

Once the tool 104 has been lowered to the desired depth (which may be just above the blind rams 26*a*), a cable clamp 108 (as seen in FIG. 13) is fastened onto the wireline 106 on top of the casing lubricator 105 and the operator attached the rope socket 140 to the wireline 106. The cable clamp 108 is commercially available from Bowen Oil Tools under the name cable t-clamp.

Figure 9:
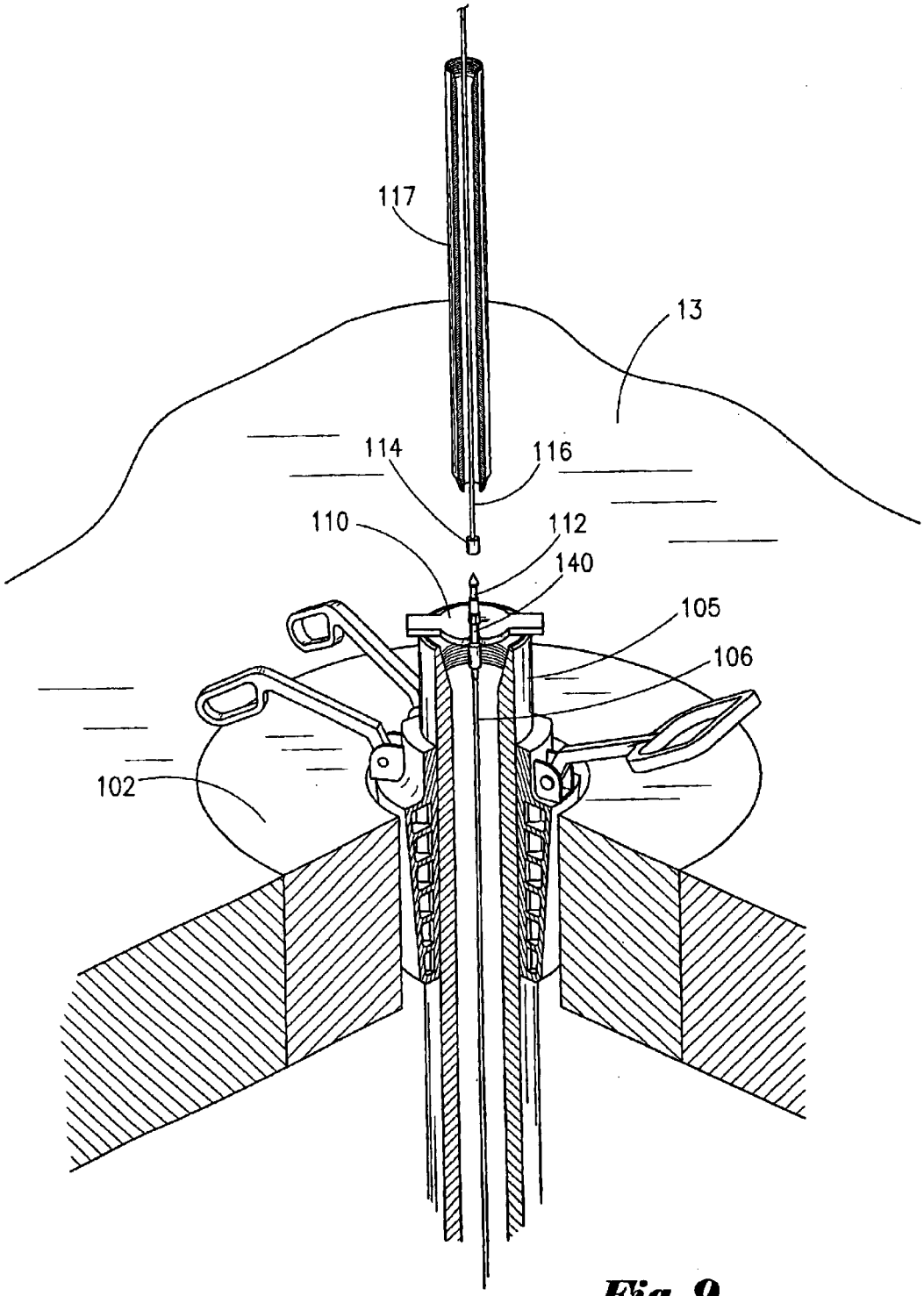
FIG. 9 illustrates a more detailed view of the rig floor with the casing lubricator in the rotary table of the second embodiment.

A detailed view of the rig floor 13 with the casing lubricator 105 within the rotary table 102 is seen in FIG. 9. A c-plate 110 is used to strip into the riser 18 with the drill string lubricator 118. The c-plate 110 will engage with a rope socket 140 attached to the wireline 106. The c-plate 110 is commercially available from Bowen Oil Tools under the name c-plate. It should be noted that the cable clamp 108 and c-plate 110 will be discussed in greater detail later in the application.

As seen in FIG. 9, the wireline 106 is suspended at the top of the casing lubricator 105 via the c-plate 110. The wireline 106 sticking up at the top of the casing lubricator 105 will have a connector 112 that can be latched to a connector head 114 of a stripping cable 116. FIG. 9 depicts this process wherein the c-plate 110 has suspended the wireline 106. A first drill pipe joint 117 is shown positioned above the casing lubricator 105 and wherein the stripping cable 116 has been lowered through the inner diameter of the drill pipe joint 117. The stripping cable 116 has a connector head 114 that will be latched onto the connector 112 of the wireline 106. Once the connectors have been latched together, the drill pipe joint 117 and casing lubricator 105 can be threadedly connected. The stripping cable 116 can be wireline, braided line, electric line or other cable. It should be noted that FIG. 9 does not show a cross-over sub means that may be required to threadedly mate the larger casing to the smaller drill pipe, as is well understood by those of ordinary skill in the art.

Stripping a cable into the inner portion of a tubular member is well known in the art, but will now be described in more detail. The procedure for stripping into the joints of drill pipe include rigging up a stripper wireline unit (not shown) in order to strip the stripping cable 116 into the drill pipe that is being lowered into the riser 18. It should be noted that the rigging up of the stripper wireline unit includes tying the stripper wireline unit down on rig floor 13, placing a sheave at the crown of the rig 12, and placing sinker bars with the connector 114 at the end of the stripping cable 116.

Figure 10:
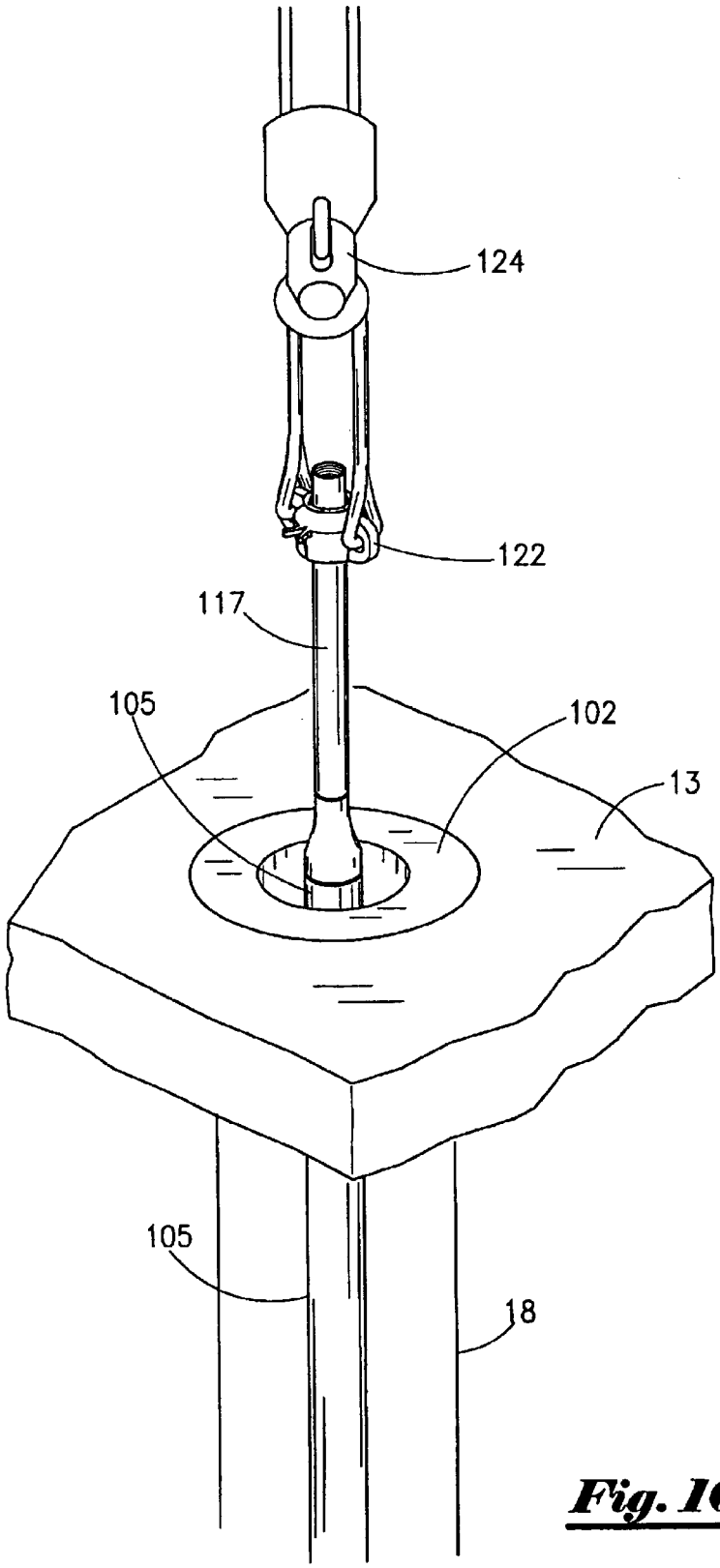
FIG. 10 illustrates a view of the elevators lowering the lubricator into the riser in the second embodiment.

Hence, the steps of stripping the stripping cable 116 into the drill string lubricator 118 may be summarized with a collective reference to FIGS. 9 and 10 as follows:

1. Raising a sinker bar means to a derrick man located in the monkey boards of the rig 12; the derrick man places the sinker bar means into the inner diameter of the drill pipe joint 117. Note that the sinker bar means are attached to the end of the stripping cable 116.

2. The derrick man will latch the drill pipe joint 117 into elevator means 122, with the elevator means 122 being connected to the traveling block 124 of the rig.

3. The connector head 114 on the stripping cable 116 is attached to the connector 112 on the wireline 106 and weight of the wireline is picked up in order to remove the c-plate 110.

4. Stabbing the drill pipe joint 117 into the casing lubricator 105 and thereafter threadedly connecting the two; the stripping cable 116 of the stripping unit does move longitudinally up or down during the stripping process. Generally, the wireline 106 does not move longitudinally up or down during the stripping process. As noted earlier, a cross-over sub means may be required.

5. Removing the rotary slips and concentrically lowering the made-up drill pipe joint 117 and the casing lubricator 105 into the riser 18.

6. Placing the rotary slips into the rotary table 102 in order to hold the drill pipe joint 117 at the rig floor 13.

7. Sliding the c-plate 110 under the connector 112 on top of the drill pipe joint 117; and, unlatching the connector head 114 from the connector 112.

Steps 1–7 are repeated in order to strip the entire drill string lubricator 118 into the riser 18. FIG. 10 depicts a sequential step of lowering the casing lubricator 105 and the threadedly attached drill pipe joint 117. The elevators 122, which are operatively attached to the block 124, are used to lower the tubulars into the riser 18.

Figure 11:
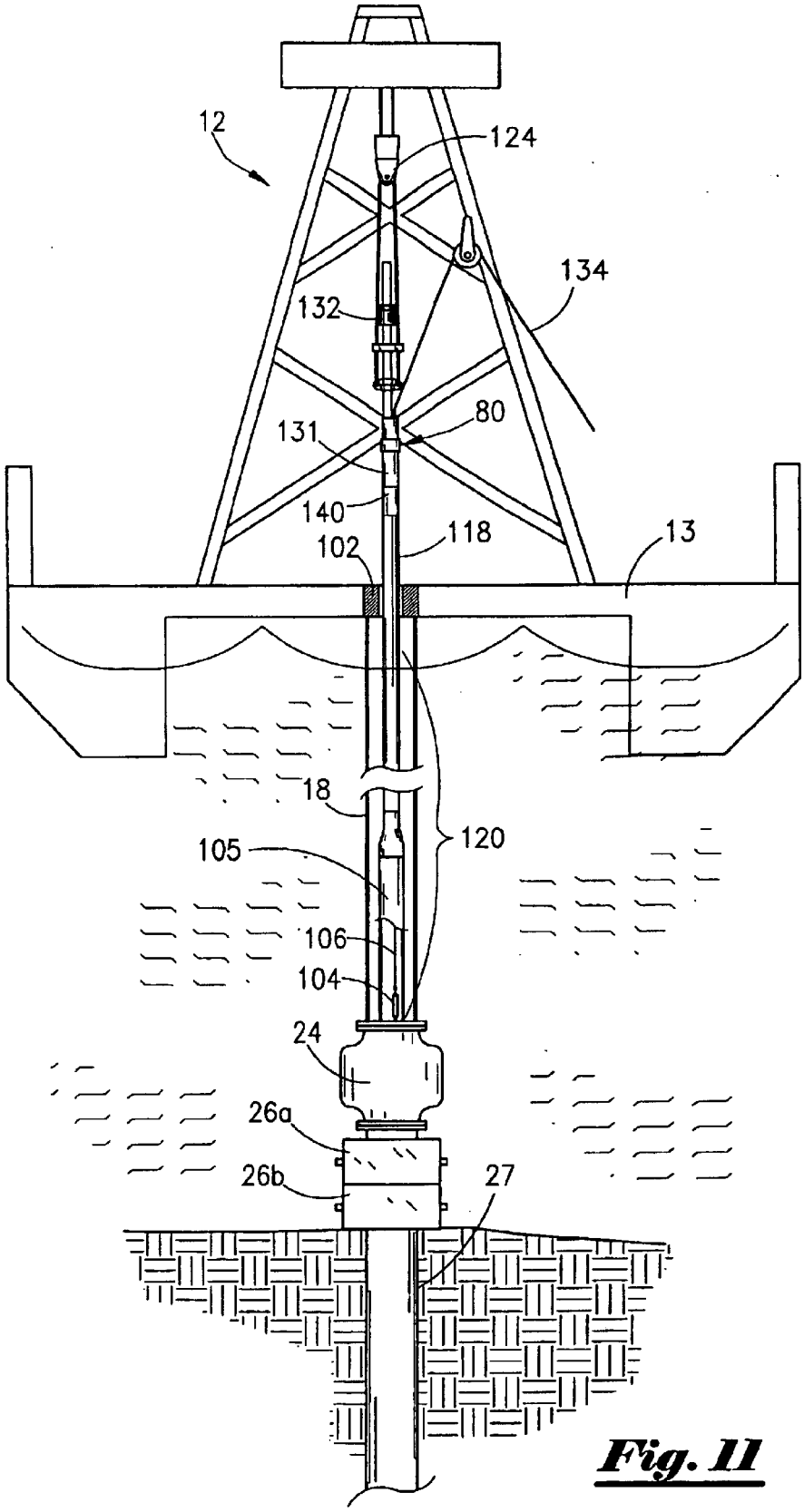
FIG. 11 illustrates a sequential view of the lubricator and control head assembly in place with the wireline tool lowered to the blind rams in the second embodiment.
Figure 12:
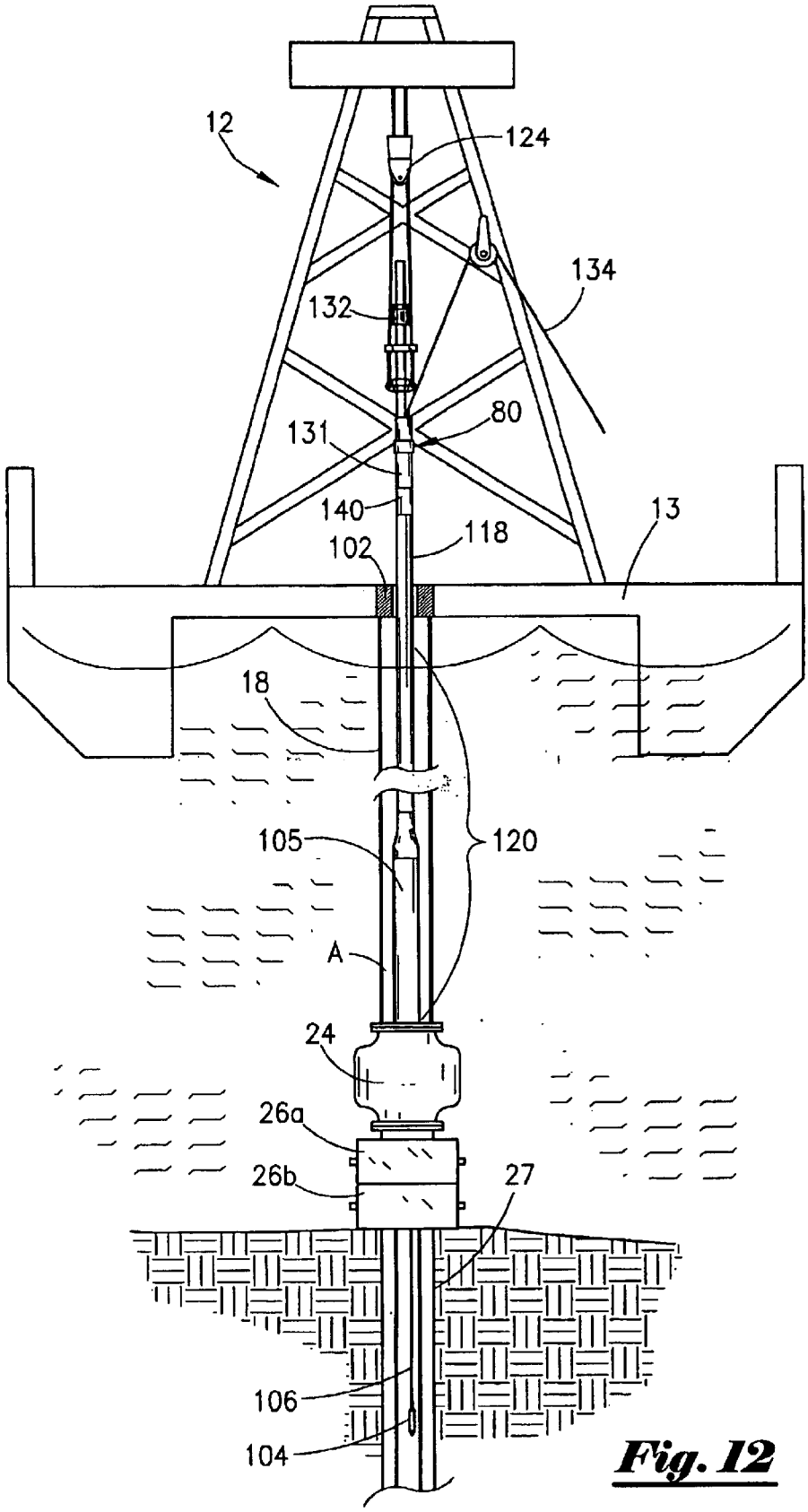
FIG. 12 illustrates a sequential view of the lubricator and control head assembly seen in FIG. 11 with the wireline tools being lowered into the well.

As noted earlier, the wireline tool 104 requires use of the large inner diameter of the casing lubricator 105; however, at least a portion of the lubricator 120 can be of the smaller diameter size (drill pipe) as seen in FIGS. 11 and 12 in order to safe time, money, and many other advantages as pointed out earlier.

Therefore, the sequential lowering into the riser of the individual joints of drill pipe that make up the lubricator 120 includes the process of stripping the stripping cable 116 into the individual joints of drill pipe. The stripping into the individual joints of drill pipe continues until the casing lubricator 105 is lowered to the annular preventer 24. Once the casing lubricator 105 is at the annular preventer 24, the annular preventer 24 is closed about the casing lubricator 105 thereby forming a seal.

After completing stripping into the riser 18, the operator would rig down the stripper wireline unit and rig up a control head assembly. As seen in FIG. 11, the control head assembly 80 is connected below a top drive assembly 132, with the top drive assembly 132 being operatively connected to the block 124 of the rig 12. Note that the control head assembly 80 may be of the type disclosed in FIG. 5 or a side entry device of the type illustrated in FIGS. 3, 4A–4C. Examples of the control head assembly include the embodiment of FIG. 5. Examples of the side entry device include the embodiment of FIGS. 3 and 4A–4C.

As seen in FIG. 11, the wireline 134 is made up through the control head assembly 80. The connector (not shown) of the wireline 134 is made up to the connector 112 of the wireline 106 so that wireline 134 and wireline 106 are attached together. Under the scenario that the wireline is an electric line, the operator can then test and check for a complete circuit so that the wireline tool 104 is capable of being energized and properly operated. Next, the control head 80 is made up to control and isolate well pressure within the well 27.

In one embodiment, it is possible to rig up a swivel means 131 that would allow optional rotation of the entire system including the lubricator 120, if such a feature is desired, as understood by those of ordinary skill in the art. The swivel means 131 would be placed below the control head 80. The swivel means 131 may be of the type referred to as lockable swivel means. It is further possible to place a drill pipe blow out preventor means 140, which is commercially available, below the swivel means 131, but above the rotary table 102.

FIG. 12 depicts the casing lubricator 105 and the drill string lubricator 118 (collectively referred to as lubricator 120) concentrically within riser 18, along with the wireline tool 104 being lowered into the well 27 with the control head 80 in place. Additionally, by having the casing lubricator 105 sealingly disposed within the annular preventer 24, an annulus area A is created.

In a preferred embodiment, the method may further comprise performing a pressure test with the lubricator 120 concentrically within the riser 18, namely the casing lubricator 105 is within the closed annular preventer 24 and the lubricator 120 extending therefrom. This allows for checking to make sure there is a seal between the casing lubricator 105 and the annular preventer 24.

Once the operator determines it is proper to open the blind rams 26*a*, the blind rams 26*a* are opened and the wireline 106 is lowered into the well 27. The operator can then perform wireline operations. The wireline operations may include logging the subterranean reservoirs for hydrocarbons, checking on cement bonding to the casing, production profiling, etc. With the design of the present invention, the operator would be able to monitor the pressure within the lubricator 120 during the operations thereby preventing pressure related problems, pollution, etc.

Referring again to FIG. 5, the embodiment of the control head assembly 80 allows the wireline 32 on a first side. Note that in the FIGS. 1–7, the wireline is referred to as 32 and the wireline tool is referred to as 34, while in FIGS. 8–14, the wireline is referred to as 106 and the wireline tool is referred to as 104. On a second side of the control head 80, there is contained a mud flow passage 135. In the case where a pressure increase is experienced within the well 27 or riser 18, it is possible to pump a fluid down the mud flow passage. The pumping of heavy fluids can be used to suppress the pressure and control and/or prevent any type of blowout. The control head assembly 80 is commercially available from Boyd's Bit Service Inc. under the name Side Entry Tool.

Once the wireline tool 104 has completed the task, the process may further include pulling the wireline 106 and the wireline tool 104 out of the well 27. Once the wireline tool 104 is above the blind rams 26*a* and pipe rams 26*b* of the subsea BOP stack, the operator can close the blind rams 26*a* to seal off the well pressure. The pressure within the lubricator 120 is then bleed off. Now, with the blind rams 26*a* closed, if the wireline tool 104 becomes detached from the wireline 106 for any reason the blind rams 26*a* would prevent the wireline tool 104 from falling down hole and keeping the well controlled.

The operator would extract the wireline 106 until the tools are below the junction of the casing-drill string intersection. Once the operator determines that the wireline tool 104 is at this position, the control head assembly 80 would then be rigged down. This would include breaking the connection of the drill string at the rig floor 13 (the connectors will be at the rig floor) and making up the c-plate 110, on top of the drill string lubricator 118. Next, the wireline is slacked off and the wireline is disconnected via the connector 112. The control head assembly 80 can then be removed.

The method would include stripping the drill string lubricator 118 out the riser 18 until the first stand of the casing lubricator 105 is at the rotary table 102 of the rig floor 13. The process of stripping out of the well is essentially the same as stripping into the well, except in reverse. The wireline is stripped one drill pipe stand at a time. Once the drill string lubricator 118 is racked back in the derrick, then the wireline tools 104 are completely removed from the casing lubricator 105.

Next, the remainder of the casing lubricator 105 is pulled from the riser 18. This process is accomplished by setting the drill collar slips to set the casing at the rig floor, disconnecting and then sequentially pulling out all the remaining casing joints in this manner, said process being very well known in the art.

In FIG. 13, the t-clamp 108 is made-up about the wireline 106, and is resting on the top of the casing lubricator 105. The t-clamp 108 is used after the casing lubricator 105 has been run into the riser 18 and the operator is setting up to run in the riser 18 with the drill pipe joints 117. The t-clamp 108 is attached to the wireline 106 and hung off the tubular. Then, the wireline 106 is cut, and thereafter, a rope socket 140 is attached to the wireline 106, with the rope socket 140 forming a part of the connector 112. Once wireline 106 is attached to the stripping cable 116, the t-clamp 108 can be removed. Thereafter, the c-plate 110 can be used.

Figure 14:
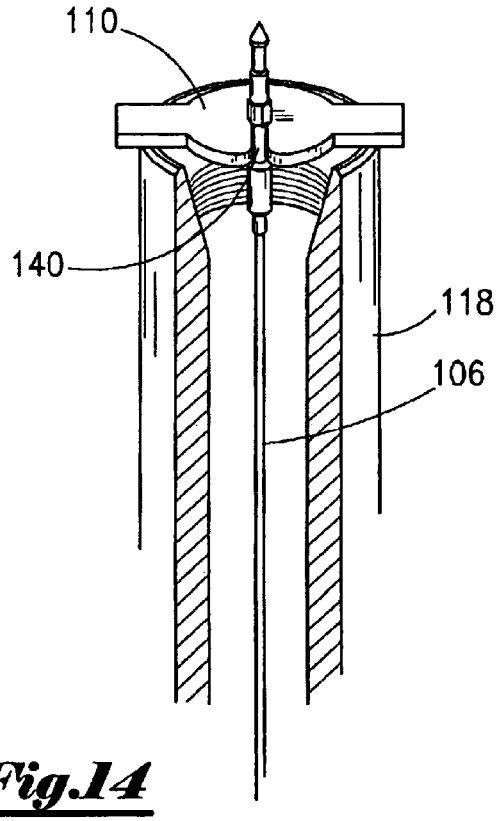
FIG. 14 illustrates a typical c-clamp employed with the invention herein described.

Reference is now made to FIG. 14 which illustrates a typical c-plate 110 employed with the invention herein described. Thus, the c-plate 110 is made up about the wireline 106, with the wireline 106 having at the top end a rope socket 140. The c-plate 110 attaches to the rope socket 140, as is well understood by those of ordinary skill in the art. The entire down hole wireline assembly (including wireline 106 and wireline tools 104 seen in FIGS. 11 and 12) is allowed to come to rest on each individual joint of drill pipe of the drill string lubricator 118, disposed through the rotary table.

The foregoing embodiments are presented by way of example only; the scope of the present invention is to be limited only by the following claims and the proper scope of equivalents thereto.

What is claimed is:

1. A method of lowering a wireline tool on a wireline into a subsea well comprising:

a) providing a rig having a riser extending from a rig floor, with the riser extending to a blowout preventer stack (BOP) on the sea floor;

b) lowering a casing lubricator concentrically into the riser;

c) concentrically lowering the wireline tool through the casing lubricator;

d) suspending the wireline at the top of the casing lubricator;

e) placing within an internal portion of a first drill pipe a stripping cable;

f) connecting the stripping cable to the wireline suspended at the top of the lubricator;

g) connecting the first drill pipe to said casing lubricator;

h) lowering the casing lubricator and the first drill pipe;

i) suspending the wireline at the top of the first drill pipe;

j) disconnecting the wireline from the stripping cable;

k) placing the stripping cable within an internal portion of a second drill pipe;

l) connecting the stripping cable to the wireline suspended at the top of the first drill pipe;

m) connecting the second drill pipe to the first drill pipe;

n) lowering the second drill pipe;

o) repeating steps i through n so that a drill string lubricator is lowered within the riser and until the casing lubricator is at an annular preventor located in the BOP stack with the drill string lubricator extending up to the rotary table on the drill floor;

p) closing the annular preventer about the casing lubricator;

q) rigging up a control head means at the top of the drill string lubricator.

2. The method of claim 1 wherein the step of closing the annular preventer about the casing lubricator includes forming a seal about the casing lubricator and the method further comprising:

testing the seal about the casing lubricator.

3. The method of claim 1 wherein the step of lowering the wireline tool further includes closing a blind ram within the BOP stack and lowering the wireline tool to above the dosed blind ram.

4. The method of claim 3 further comprising opening the blind ram and lowering the wireline tool into the well.

5. The method of claim 4 wherein the wireline is an electric wireline and the method further comprises performing logging operations with the wireline tool.

6. The method of claim 1 wherein the step of suspending the wireline is accomplished by placing a cable clamp about the wireline.

7. The method of claim 1 wherein the control head is a side entry device.

8. The method of claim 7 wherein the side entry device contains a first passage for the wireline and a second passage for a fluid, and the method further includes pumping the fluid through the second passage into the drill string.

9. The method of claim 1 wherein the steps of suspending the wireline at the top of the first drill pipe includes providing a c-plate means and engaging the c-plate means with a rope socket that is attached to the wireline.

10. A method of running a wireline tool on a rig situated over a sea bed, said rig containing a riser extending to the sea bed, the method comprising:

determining an outer diameter size of a casing lubricator;

determining a length of the casing lubricator;

lowering the casing lubricator into the riser;

lowering a wireline tool on a wireline to a subsea BOP stack;

rigging up a cable clamp about the wireline on top of the casing lubricator and attaching a rope socket;

rigging up a c-plate on top of the casing lubricator and suspending the wireline with the c-plate from the top of the casing lubricator;

rigging up a stripper wireline unit;

stripping the wireline into a drill string lubricator;

rigging down the stripper wireline unit;

providing a control head below a top drive device operatively connected to an traveling block of the rig.

11. The method of claim 10 further comprising:

rigging up a swivel means below the top drive;

rigging up a drill pipe BOP below the top drive and above a rotary table positioned on the rig.

12. The method of claim 10 further comprising:

providing an annular preventer and a blind ram on the sea floor;

closing the annular preventer about the casing lubricator;

closing the blind ram;

performing a pressure test with the casing lubricator within the annular preventer and the drill string lubricator concentrically located within the riser.

13. The method of claim 12 further comprising:

opening the blind ram;

lowering the wireline tools into the well;

performing wireline operations.

14. The method of claim 13 further comprising:

monitoring the pressure within said riser.

15. The method of claim 13 wherein said control head contains a first passage and a second passage and wherein said first passage allows the wireline to be disposed therethrough and the second side contains a mud flow passage and wherein the method further comprises:

pumping a fluid down the mud flow passage.

16. The method of claim 13 further comprising:

retrieving the wireline tool from the well; and wherein once the wireline tool is above the blind ram, the blind ram is closed.

17. The method of claim 16 further comprising:

removing the control head;

stripping the wireline from the drill string lubricator and removing the drill string lubricator from the riser until the first stand of the casing lubricator is at the rotary table of the rig floor.

18. A method of lowering a wireline tool from a rig into a subsea well, said rig containing a riser extending to the sea bed, the riser being connected to an annular preventer at the seabed, the method comprising:

placing a casing lubricator concentrically within the riser;

lowering a wireline with a wireline tool extending therefrom through the casing lubricator and into the riser to a position above a blind ram in the BOP stack;

placing a cable clamp about the wireline so that the cable clamp grabs the wireline and rigging up a rope socket, and then placing a c-plate on top of the casing lubricator so that the c-plate suspends the wireline and the wireline tool;

rigging up a stripper wireline unit in order to strip a stripping cable into a drill string lubricator;

stripping the stripping cable into the drill string lubricator;

lowering the drill string lubricator and attached casing lubricator into the riser;

rigging down the stripper wireline unit;

rigging up a control head below a top drive, said top drive being operatively attached to a traveling block on the rig.

19. The method of claim 18 further comprising:

closing an annular preventer about the casing lubricator in order to create a seal;

creating an annulus between the riser and the casing lubricator and the drill string lubricator;

applying a pressure to the annulus in order to test the seal of the casing lubricator within the annular preventer.

20. The method of claim 19 further comprising:

opening a blind ram at the seabed;

lowering the wireline tools into the well;

performing wireline operations with the wireline tools.

21. The method of claim 20 further comprising:

monitoring the pressure within said annulus.

22. The method of claim 21 wherein said control head allows the wireline to be placed within a first side and a second side of said control head contains a mud flow passage in communication with the inner portion of the drill string lubricator, and wherein the method further comprises:

pumping a fluid down the mud flow passage.

23. The method of claim 22 further comprising:

pulling out of the well with the wireline tools;

closing the blind ram once the wireline tools are above the blind ram.

24. The method of claim 23 further comprising:

breaking the connection between the top stand of the lubricator assembly at the rig floor;

making up the cable damp to the wireline and making up the c-plate on top of the drill pipe;

slacking off the wireline and disconnecting the wireline at the connectors;

removing the control head;

stripping the drill string lubricator out of the riser until the first stand of the casing lubricator is at the rotary table at the rig floor.

25. A method of conducting wireline operations in a deep subsea environment, comprising the following steps:

a) providing a rig having a riser extending between the rig floor and the floor of the body of water;

b) providing at least a blowout preventer stack (BOP stack) secured to the lower end of the riser, said BOP stack having an annular preventer;

c) positioning a wireline subsea blowout preventer control head assembly at the end of the drill string, with a wireline tool disposed within the assembly;

d) securing a length of pipe to the lower end of the assembly;

e) lowering the drill string down the annulus of the riser;

f) sealingly engaging the length of pipe within the annular preventer;

g) lowering the tool on the end of a wireline disposed through the assembly as to conduct wireline operations below the BOP stack, while being able to maintain pressure on the drill string.

26. The method of claim 25, wherein the assembly comprises:

a tool body having a first lower end and a second upper end;

a principal bore through the tool body from the upper to the lower end;

a portion of the tool body having a second bore intersecting into the principal bore for allowing a wireline to be inserted through the second bore and extend from the lower end of the tool body for conducting wireline work under pressure.

27. A method of conducting wireline operations in a subsea environment, comprising the following steps:

providing a rig having a riser extending between the rig floor and the floor of the body of water;

providing an annular preventer and a BOP stack secured to the lower end of the riser;

lowering a drill string down the annulus of the riser;

positioning a wireline entry apparatus at the end of the drill string and wherein said wireline entry apparatus has a wireline tool therein;

securing a length of pipe to the lower end of the wireline entry apparatus;

sealingly engaging the length of pipe by the annular preventer and BOP stack;

lowering the tool on the end of a wireline, with the tool being disposed within the wireline entry apparatus so as to conduct wireline operations below the BOP stack, while being able to maintain pressure on the drill string.

28. The method of claim 27, wherein the wireline entry apparatus comprises:

a tool body having a first lower end and a second upper end;

a principal bore through the tool body from the upper to the lower end;

a portion of the tool body having a second bore intersecting into the principal bore for allowing the wireline to be inserted through the second bore and extend from the lower end of the tool body for conducting wireline work under pressure.

29. An assembly for conducting wireline operations in a deep subsea environment, comprising:

a wireline subsea blowout preventer control head assembly positioned at the end of a drill string, and lowered down an annulus of a riser to substantially the level of the seabed, so that the assembly may conduct wireline operations under pressure;

the wireline subsea blowout preventer control head assembly operating within the riser with an annular preventer within a BOP stack to prevent pressure from downhole to enter and adversely affect the integrity of the riser while the wireline operations are ongoing; and, a modified entry sub so that a protective sleeve may be positioned over the sub to avoid portions of the sub making contact with objects down the hole.

30. A method of lowering a lubricator into a subsea riser, the riser extending from a rig to a BOP stack at the seabed, and wherein a well extends from the BOP stack, and the method comprises:

placing a casing lubricator concentrically within the riser;

lowering a wireline with a wireline tool extending therefrom through the casing lubricator and into the riser to a position above a blind ram in the BOP stack;

lowering the drill string lubricator and attached casing lubricator into the riser, and wherein said drill string lubricator and attached casing lubricator form the lubricator;

rigging up a control head to a top portion of the lubricator.

31. The method of claim 30 further comprising:

closing an annular preventer in the BOP stack about the casing lubricator in order to create a seal;

creating an annulus between the riser and the casing lubricator and the drill string lubricator;

monitoring the pressure within said annulus.

32. The method of claim 31 further comprising:

opening a blind ram at the seabed;

lowering the wireline tools into the well;

performing wireline operations with the wireline tools.

33. The method of claim 32 further comprising:

monitoring the pressure within the inner diameter of said lubricator.

34. The method of claim 33 wherein said control head allows the wireline to be placed within a first side, and a second side of said control head contains a mud flow passage in communication with the inner portion of the lubricator, and wherein the method further comprises:

pumping a fluid down the mud flow passage.

35. The method of claim 34 further comprising:

pulling out of the well with the wireline tools;

closing the blind ram once the wireline tools are above the blind ram.

* * * * *